US005918512A

United States Patent [19]

Habermehl et al.

[11] Patent Number: 5,918,512

[45] **Date of Patent: *Jul. 6, 1999**

[54] REPLACEABLE BIT SCREWDRIVER ASSEMBLY

[75] Inventors: G. Lyle Habermehl, 436 Calvert Dr., Gallatin, Tenn.; Paul Towsend Scherer, Lexington, Ky.

[73] Assignee: G. Lyle Habermehl, Gallatin, Tenn.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/673,615

[22] Filed: Jun. 25, 1996

Related U.S. Application Data

[63] Continuation of application No. 08/225,949, Apr. 8, 1994, Pat. No. 5,531,143, which is a continuation-in-part of application No. 08/044,956, Apr. 8, 1993, Pat. No. 5,351,586.

[51] Int. Cl.[6] ..... B25B 23/00

[52] U.S. Cl. ..... 81/438; 81/57.37; 81/177.75

[58] Field of Search ..... 81/438, 439, 177.75, 81/435, 434; 279/155

[56] References Cited

U.S. PATENT DOCUMENTS

| | | | |
|---|---|---|---|
| 1,080,560 | 12/1913 | Johanson . | |
| 1,502,528 | 7/1924 | Reulbach . | |
| 2,527,517 | 10/1950 | Barker et al. | 81/476 |
| 2,550,635 | 4/1951 | Brown et al. | 81/438 |
| 3,935,762 | 2/1976 | Tudisco | 81/438 |

FOREIGN PATENT DOCUMENTS

| | | | |
|---|---|---|---|
| 308968 | 3/1989 | European Pat. Off. | 81/177.75 |
| 548615 | 10/1942 | United Kingdom | 81/177.75 |

*Primary Examiner*—David A. Scherbel
*Assistant Examiner*—Joni B. Danganan

[57] ABSTRACT

An improved screwdriver in which a replacement bit is removably secured to a mandrel by the bit being axially slidable in an axial socket in the end of the mandrel. The bit is movable from a position coaxially aligned with the socket to a position out of alignment therefrom, to assist in the engagement and driving of misaligned screws. A resilient split-ring which serves to retain the bit in the socket is carried by and replaceable with the bit. With each new bit a new split-ring is also provided.

20 Claims, 10 Drawing Sheets

FIG. 1.
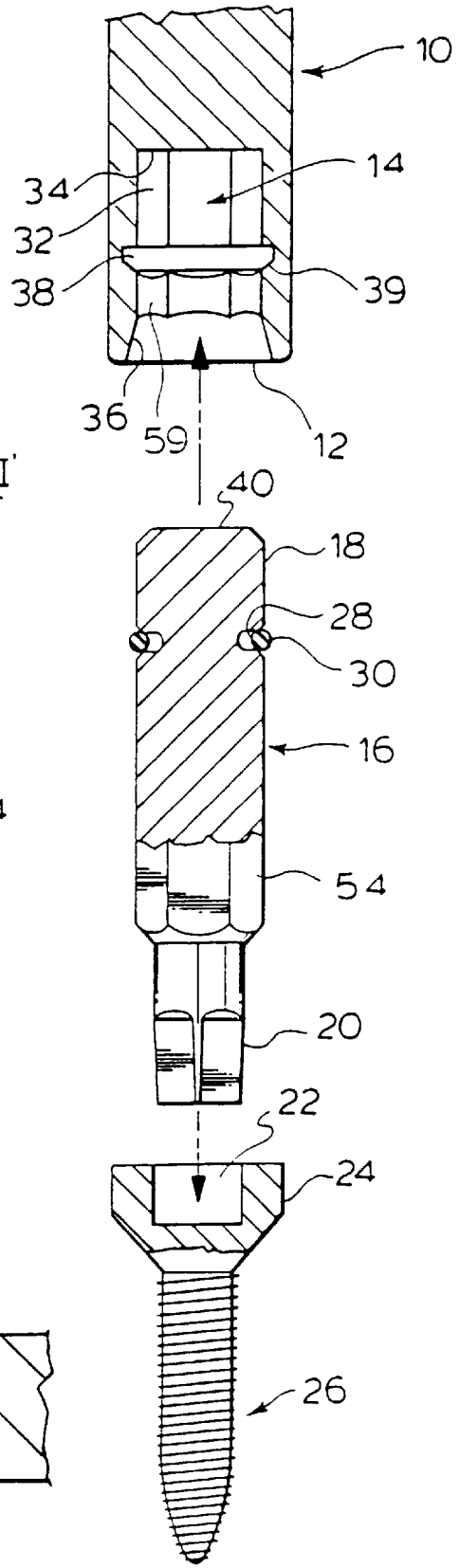
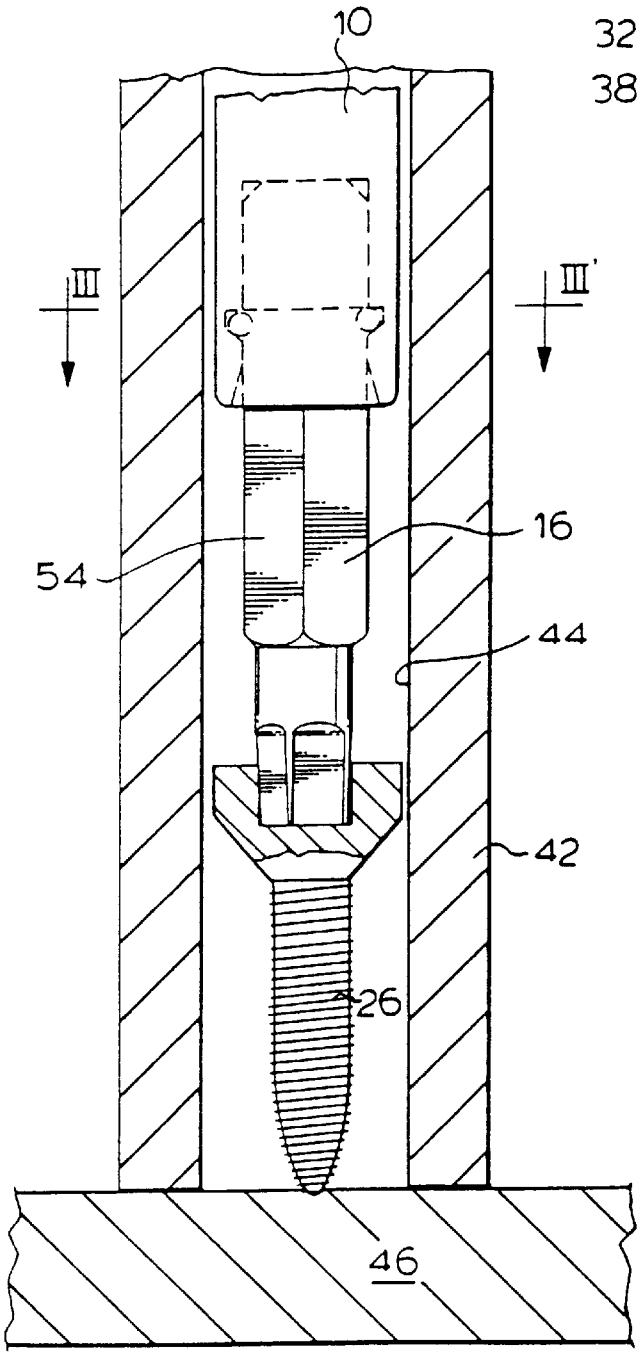
FIG. 2.

REPLACEABLE BIT SCREWDRIVER ASSEMBLY

This application is a continuation of U.S. patent application Ser. No. 08/225,949, filed Apr. 8, 1994 now U.S. Pat. No. 5,531,143 which is a continuation-in-part of U.S. patent application Ser. No. 044,956, filed Apr. 8, 1993 and issued as U.S. Pat. No. 5,351,586.

SCOPE OF THE INVENTION

This invention relates to a driver tool for engaging fasteners having a replaceable bit and, more particularly, to screwdrivers and nut drivers wherein the bit is slidably received within a socket formed in the screwdriver mandrel.

BACKGROUND OF THE INVENTION

Screwdrivers having removable bits for engaging and driving screws into a work-piece are known. These screwdrivers typically have an elongate mandrel to which at one end a bit is removably coupled.

In many screwdrivers, the bit is coupled to the mandrel by threads. For example, in a power screwdriver disclosed in U.S. Pat. No. 4,146,071 to Mueller et al, issued Mar. 27, 1970, the bit has a reduced diameter externally threaded male portion to be received within an internally threaded female socket in the mandrel. The present inventor has appreciated that a threaded coupling has the disadvantage that the mandrel and bits are both expensive and, as well, render it difficult and time consuming to change the bit.

The power screwdriver of U.S. Pat. No. 4,146,071 utilizes a system in which the head of a screw is located and retained in coaxial alignment with the mandrel and bit by the head of the screw engaging a part-cylindrical guideway member having a diameter approximately equal to the diameter of the head of the screw. In such a configuration, it is necessary that the mandrel and bit be of a sufficiently small diameter that the mandrel and bit may reciprocate axially through the part-cylindrical guideway member. The constraints of the mandrel and bit being of a diameter not greater than the diameter of the screw head, renders replacement of the threaded coupling of the bit to the mandrel with another system difficult.

Other bit to mandrel coupling systems are known in which the mandrel carries a resilient split-ring in a deep groove in a socket in the mandrel. When the bit is inserted into the socket, the split-ring retains the bit in the socket by the split-ring being partially received in a groove about the bit. Such known systems suffer the disadvantage that with repeated use, the split-rings come to fail as by losing their resiliency. Failure of the ring, whether resulting in jamming of the bit in the socket or fracture of the split-ring, results in expensive replacement of the mandrel since the split-ring is carried by the mandrel.

Insofar as the external diameter of a mandrel must be limited to the diameter of the head of the screw, serious disadvantages arise in the use of known split-ring systems. Firstly, with reducing diameter of the mandrel, the split-ring must be reduced in size. Reducing the size of the split-ring greatly, disadvantageously, affects the reliability of the split-ring, its consistency in manufacture and increased likelihood of a failure of the coupling system. In systems which the split-ring is carried by the socket, the present inventor has appreciated the disadvantage that the side wall of the mandrel about the socket must have sufficient radial depth to receive the split-ring totally therein. This requires increased thickness of the mandrel about the socket. Machining the socket to have a groove with a radial depth sufficient to totally receive the split-ring becomes increasingly difficult with sockets of smaller diameter. Using smaller diameter split-rings has the disadvantage that in ensuring a bit is secured against removal, the split-rings must be selected such that forces required to axially withdraw the bits become great due to the variance of the small split-rings when manufactured. Frequently, small diameter split-rings only permit withdrawal of a bit with extremely considerable forces as requiring the use of a vice or pliers or are too easily removed.

A further difficulty with conventional power screwdrivers is that in operation, the head of the screw which is to be driven frequently is misaligned, locating several degrees out of axial alignment with the mandrel and bit. The result is that when the bit is moved to engage the screw head, the screw tends to "cam out", wherein as the screw is driven, it moves further out of axial alignment with the bit and mandrel until the bit can no longer properly engage the screw head. In addition to difficulties in keeping the bit engaged in the screw head, when driving a screw which has moved out of axial alignment, the bit frequently becomes wedged in the slot of the screw head as a result of different axial orientations of the bit and screw. A bit which has become wedged in the screw head may remain jammed in the screw head so as to be withdrawn from the socket on reciprocal upward movement of the mandrel as the screwdriver is positioned to drive the next screw.

SUMMARY OF THE INVENTION

To at least partially overcome the disadvantages of the prior devices, the present invention provides in one aspect, most preferably for use in a screwdriver in which the mandrel and bit are sized to be not larger than the head of a screw to be driven, an improved bit to mandrel coupling assembly in which the bit is axially slidably received in a socket in the mandrel with the bit removably coupled therein by a resilient coupling device such as a split-ring carried by and removable with the bit.

To overcome other disadvantages of the prior art, the present invention provides in another aspect, a screwdriver with a bit axially slidably received in a socket in the mandrel, a separate lever tool to simultaneously engage both the bit and socket to exert considerable axially directed forces to the bit and release the bit from the socket.

To overcome other disadvantages of the prior art, the present invention provides in another aspect, an improved bit to mandrel coupling assembly for a screwdriver in which a bit coupled for rotation with the mandrel is free to pivot relative the mandrel in a ball-and-socket manner to permit movement of the bit relative to the mandrel axis, to orientations to better engage the heads of screws which are positioned out of axial alignment with the mandrel.

An object of the invention is to provide an improved removable bit for use with screwdrivers, particularly power screwdrivers.

Another object of the invention is to provide a system for removably coupling a screw engaging bit into a screwdriver mandrel which permits the diameter of the mandrel to be reduced as far as possible.

Another object of the invention is to provide a system for removably coupling a bit into a screwdriver mandrel by which a resilient coupling is replaceable with the bit.

Another object of the invention is to provide a socket adapted for use with a lever tool to assist in removal of bits received in the socket.

Another object of the invention is to provide a screwdriver incorporating a bit assembly which reduces the likelihood of screw "cam out" when driving screws.

Another object of the invention is to provide a bit assembly for a screwdriver which reduces the likelihood of the bit becoming jammed in a screw head.

Another object is to provide a screwdriver bit received in a socket such that the bit may move within the socket in a ball-and-socket type relation.

The present invention provides a screwdriver with a socket to hold a replaceable bit. In one aspect of the invention, the bit has a circumferential groove in which a resilient split-ring is located and thereby secured to the bit. The split-ring removably locks the bit in the socket by engaging into a complementary groove in the socket. As the split-ring is carried by the bit, advantageously, the split-ring is replaced every time a new bit is used and failure of the split-ring does not require replacement of the socket. Providing the split-ring to be carried on the bit is advantageous to reduce the exterior diameter of the socket required to receive a bit since the groove in the socket to be engaged by the split-ring need not be of a depth sufficient for the split-ring to be entirely received therein.

Bits carrying their own split-rings and complementary sockets are particularly advantageously adapted for use with power screwdrivers to drive collated screws in which the socket is not greater than the head of a screw to be driven.

In bits carrying their own split-rings, the groove circumferentially about the bit must have sufficient radial depth to permit the split-ring to substantially compress into the groove. This groove can therefore substantially weaken the bit. As the groove may not be sufficiently strong to transmit rotational forces necessary to drive a screw, preferably, rotational forces are transferred between the bit and socket only forwardly from the groove so that these rotational forces are not transferred axially along the bit across the groove. Similarly, laterally directed forces acting on the bit preferably should not be transferred across the groove. Preferably, lateral forces acting on the bit rearward of the groove are minimized.

In another aspect, the bit and socket are complementarily shaped and sized so as to permit the bit to adopt various orientations in which a central bit axis is inclined relative a central socket axis. By this ability to assume inclined positions, the bit is permitted to move in the manner of a ball-and-socket within the socket. The bit is permitted to incline to at least 2° relative to the socket and, more preferably, to at least 3° to 10°. The bit is limited to a maximum angle of inclination by engagement between the side wall of the bit and the socket. Providing the bit to move in a ball-and-socket manner in the socket is believed to assist in improved engagement between the bit and screws and to prevent "cam out" particularly when the screw may be disposed at an angle to the axis of the screwdriver. Bits which may incline relative a socket are particularly advantageous with power screwdrivers for driving collated screws in which a screw to be driven is engaged in a slide which reciprocates axially relative the mandrel to drive the screw.

Where a bit carrying its own split-ring is to be permitted to incline relative a socket then, preferably, the engagements between the bit and socket which limit inclination of the bit will be forward of the groove carrying the split-ring so that laterally directed forces acting on the bit are not transferred through the bit across the groove. This can be aided by having rear surfaces of the bit to contact the rear of the socket and adapted to transfer axially directed forces also being adapted to permit the rear end of the bit to slide laterally relative the socket.

In yet another aspect, the present invention provides a lateral slot into the socket rearward of the end of the bit into which slot a lever tool may be inserted to apply axially directed forces to the bit and remove it from the socket. Such a slot and tool are particularly useful with bits carrying its own split-ring, so that the split-rings may be configured to hold the bits in the socket against removal manually with the use of pliers. Such tightly held bits will not be removed in normal use of the screwdriver yet can readily be removed by the tool. Such sockets with slots and removal tool are particularly useful for screwdrivers for collated screws so as to permit ease of removal of bits without substantial disassembly of the tool.

Accordingly, in one aspect the present invention provides an apparatus for automatically power driving fasteners, such as screws or the like, which are joined together in a strip comprising:

housing means;

power drive means secured to the housing means;

drive shaft means operatively connected to the power drive means for rotation and defining a longitudinal axis;

slide body means coupled to the housing for reciprocal displacement parallel to the axis of the drive shaft means;

screw feed means to receive the fastener strip and advance successive screws in the fastener strip into substantially axial alignment with said drive shaft means for engagement by the drive shaft means on reciprocal displacement of the slide body means relative the housing means;

the improvement wherein the drive means comprises elongate mandrel means having at a forward end screw engaging bit means coupled to the mandrel means for rotation therewith about the axis of the drive shaft means;

the bit means coupled to the mandrel means whereby the bit means may pivot in a substantially ball-and-socket manner relative the mandrel means from an orientation in which a longitudinal axis of the bit means is coaxial with the axis of the drive shaft means to orientations in which the axis of the bit means is inclined at an angle of at least 2° relative the axis of the drive shaft means. When the bit means is inclined at an angle relative the axis of the drive shaft means, the screw engaging end of the bit means is disposed away from the axis of the drive shaft means to assist the screw engaging end in engaging and maintaining engagement of a screw which is not coaxially aligned with the axis of the drive shaft means.

In another aspect, the present invention provides a screwdriver having elongate mandrel means rotatable about a longitudinal mandrel axis therethrough and having at a forward end socket means, the socket means extending rearwardly along the mandrel axis from a socket opening in the forward end of the mandrel to an inner rear end, the socket means having an interior shape and size, screw engaging bit means having a bit axis extending longitudinally therethrough from a forward end to a rearward end, the bit means having an exterior shape and size complementary to the interior shape and size of the socket means, the bit means received generally coaxially in the socket means for rotation therewith with the forward end of the bit means extending from the socket opening for engaging and driving a screw into a work-piece, the improvement wherein, the relative shapes and sizes of each of the bit means and the socket means are selected such that when the bit means is received in the socket means the bit means is free to move between a first orientation wherein the bit axis is aligned with the mandrel axis, and a plurality of second orientations wherein the bit axis is inclined at an angle of at least 2° relative to the mandrel axis.

BRIEF DESCRIPTION OF THE DRAWINGS

Further aspects and advantages of the present invention will appear from the following description taken together with the accompanying drawings in which:

FIG. 1 shows an exploded partial cross-sectional side view of a first embodiment of the present invention including a mandrel and a replaceable bit aligned with a screw to be driven;

FIG. 2 shows a partial cross-sectional side view of the mandrel, bit and screw of FIG. 1, coaxially received within a cylindrical guideway;

DETAILED DESCRIPTION OF THE PREFERRED EMBODIMENTS

Figure 3:
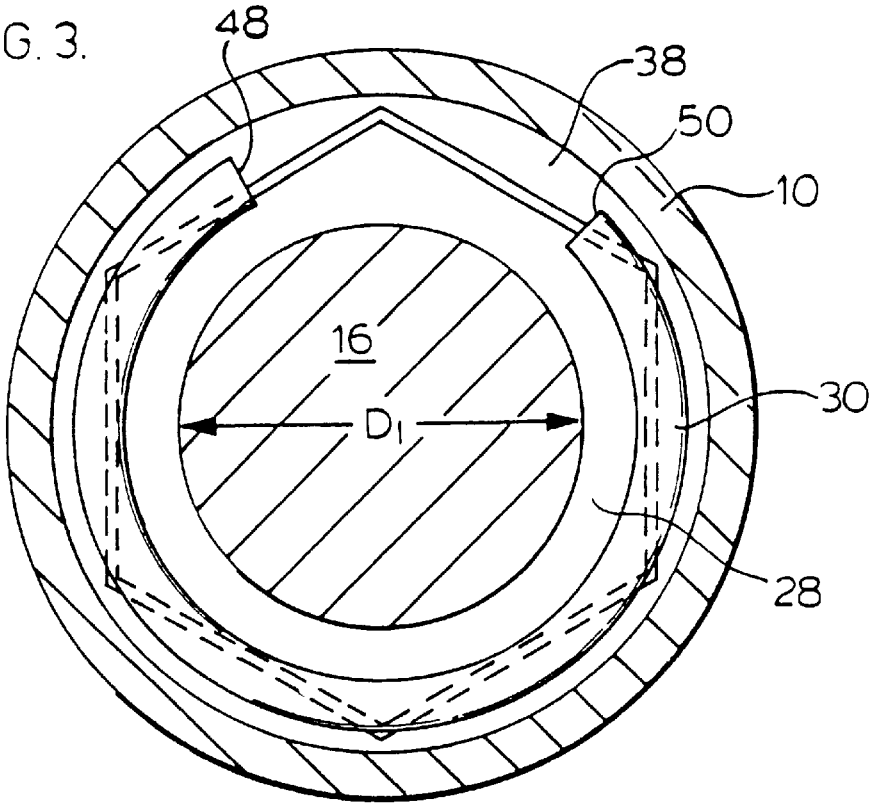
FIG. 3 shows a cross-sectional view of the mandrel and bit of FIG. 2 taken along lines III—III'.

Reference is made first to FIG. 1 which shows as a first preferred embodiment of the invention, an elongate mandrel 10 having at a forwardmost end 12 an axially rearwardly extending socket 14 adapted to axially slidably receive a replaceable screw engaging bit 16.

The bit 16 is elongated along a longitudinal axis extending from a screw driving tip 20 at a forward end rearwardly into a hexagonal shaped body 18. Tip 20 is adapted for engaging a complementary shaped slot 22 formed in the head 24 of a screw 26. A circumferential groove 28 is formed in body 18 to extend radially inwardly into the body normal to the axis of the bit 16. A split-ring 30, which is elastically deformable from an unbiased to a biased configuration, is retained within groove 28, and is thereby carried with and secured to bit 16. The split-ring 30 comprises, preferably, a piece of metal having a circular cross-section, and which is formed so that when unbiased, the split-ring 30 has an elastic tendency to return to a generally circular configuration of a set diameter.

The hexagonal shaped body 18 of the bit 16 is adapted to be slidably received in socket 14 formed in mandrel 10. Socket 14 has an interior hexagonal portion 59 hexagonal shaped in cross-section, with six axially parallel planar side walls 32 closed by an end wall 34. A forwardmost mouth portion of the socket has frustoconical side walls 36 which taper inwardly from the forwardmost end 12 into the hexagonal portion and assist in guiding a bit 16 to be inserted into the socket. A circumferential groove 38 is formed in the side walls 32 extending radially outwardly about the socket 14 rearward from end 12.

As is to be appreciated, the hexagonal shaped body 18 of the bit 16 is sized for sliding insertion into the socket 14 via its open end. When fully received within socket 14, the rearward end 40 of the bit 16 opposite tip 20 is in abutment with the end wall 34 of the socket and groove 28 of the bit aligns with the groove 38 of the socket whereby the split-ring 30 locates in part in each of the grooves 28 and 38 to restrict removal of the bit 16. The length of the bit 16 is selected so that when fully inserted into the socket 14, the tip 20 extends forwardly beyond the open axial end of the socket a sufficient distance to permit unhindered engagement of the tip 20 in the screw head 24. The side walls 32 of the socket 14 are complementary to the exterior planar sides 54 of the hexagonal shaped body 18 and which extend parallel to the axis of the bit 16. On rotation of the mandrel 10, the side walls 32, as a rotational force transmitting portion, engage the sides 54 of hexagonal body 18 as a rotational force receiving portion to rotate of the bit 16 with the socket 14.

FIG. 2 shows the mandrel 10 and a screw 26 coaxially aligned in operative engagement within a guideway 42. The guideway illustrated comprises hollow cylindrical tube having an inside diameter equal to or marginally greater than the diameter of the screw 26 to be driven. The guideway 42 serves a number of different functions. Preferably, it serves to locate and guide screw 26 coaxially therein by engagement between the circumferentially outermost portions of the head 24 of the screw and radially innermost walls 44 of the guideway. This assists the mandrel and bit which, preferably, rotate and are coaxially slidable in the guideway 42 in, amongst other things, engaging the slot 22 in the screw 26 and driving the screw into a work-piece 46.

Guideways having some similarity to that illustrated in FIG. 2 are described, for example, in power screwdrivers of the type disclosed in U.S. Pat. No. 4,146,071 and PCT patent application PCT/CA94/00082, both of which are incorporated herein by reference.

For certainty, the nature and operation of the split-ring 30 is duscussed in detail with reference to FIGS. 1, 2, 3 and 4.

Split-ring 30 is secured to bit 16 within the groove 28 against removal by the split-ring extending about the bit a sufficient axial extent. In this regard, the distance between the ends 48 and 50 of the split-ring when unbiased should be less than the innermost diameter D1 of the bit radially inside groove 28. As seen in FIGS. 2 and 3, when unbiased, the split-ring 30 is located in part within groove 28 and in part within groove 38. The groove 28 within the bit 16 is sufficiently deep, that is, it has a radial depth sufficient, having regard to the thickness of the metal forming the split-ring 30, that when the split-ring 30 is biased radially inwardly as seen in FIG. 4, the split-ring 30 may be received effectively totally within the groove 28, with the split-ring 30 preferably disposed between the radially innermost surface 52 of the groove 28 and the outer sides 54 of the hexagonal shaped body 18 and at least between surface 52 of groove 28 and walls 32 of the socket 14.

FIGS. 1 and 2 show best the insertion and retention of the bit 16 within the socket 14. With the hexagonal shaped body 18 of the bit 16 and the hexagonally shaped socket 14 axially aligned and in registry, the end 40 of the bit 16 is axially slidably inserted into the open end of the socket 14.

As the split-ring 30 is moved rearwardly into the socket 14 by forces applied axially to the bit, firstly, the tapering side walls 36 of the mouth portion and subsequently the side walls 32 of the hexagonal inner portion contact radial outermost portions of the split-ring 30 compressing the split-ring inwardly into groove 28 to a biased configuration similar to that shown in FIG. 4. The split-ring 30 remains compressed within groove 28 until groove 28 is moved into alignment with groove 38 when the split-ring 30 expands to the substantially unbiased configuration of FIG. 3. As seen in FIG. 3, with the bit 16 fully inserted in the socket 14, the split-ring 30 is located partially in groove 28 and partially in groove 38 locking the bit 16 against axial withdrawal.

Figure 4:
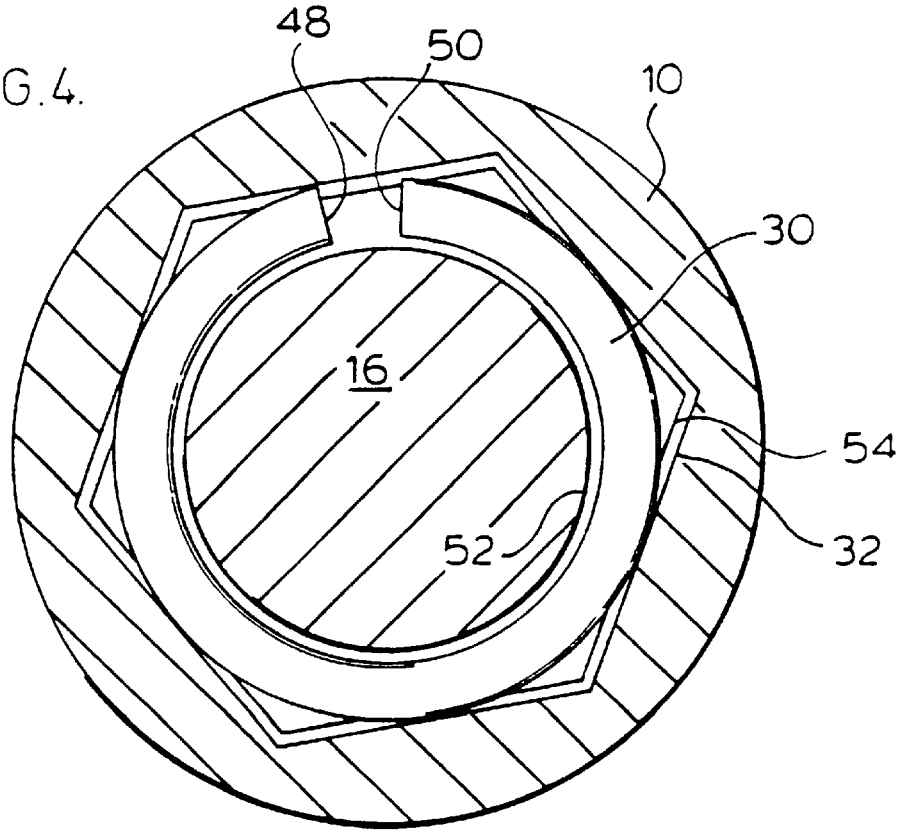
FIG. 4 shows the same cross-sectional view through the bit as in FIG. 3 but with the bit axially moved within the socket sufficient that the groove in the bit does not align with the groove in the mandrel.

The bit 16 may be removed from the socket 14 by applying a required axially directed force sufficient that engagement between forward edge 39 of the groove 38 of the socket and the split-ring 30 causes the split-ring 30 to be forced to a compressed configuration as shown in FIG. 4. The forces required for withdrawal of the bit may typically be required to be considerable so as to prevent the removal of the bit 16 under forces experienced in normal screwdriving conditions. The forward edge 39 of groove 38 is preferably disposed at an angle to the central axis to tilt radially inwardly and axially forwardly. Having forward edge 39 at an angle permits the forward edge 39 to cam the split-ring 30 radially outwardly and permits the bit 16 to be withdrawn by applying axially directed forces. In contast, groove 28 preferably has edges which extend perpendicular to the bit axis.

As split-ring 30 is carried by the bit 16, and retains the bit 16 in the socket 14 locating only partially within the groove 38, the groove 38 in the socket may have a depth less than the thickness of the split-ring 30. Preferably, the groove 38 may have a radial depth which is less than the thickness of the split-ring 30 and, more preferably, less than ½ of the depth of the split-ring 30. This permits the thickness of the walls of the mandrel about the socket 14 to advantageously be small allowing the mandrel 10 to have as small an exterior diameter as possible.

Having regard to a system as in FIG. 2, where the mandrel 10 is to be axially slidable in a guideway 42 of a diameter approximately equal to the maximum diameter of a screw head 24, it is important to have as small a diameter for the mandrel as possible. This is particularly so when driving screws having small head diameters of ½ inch or less and, more preferably so, with screw head diameters of less than ⅓ inch, less than ¼ inch and less than 3⁄16 inches. For example, common number 12 wood screws have outer head diameters of about 7⁄16 inch; common number 8 wood screws having a head diameter of about 5⁄16 inch and common number 8 wood screws having outer head diameters of about ¼ inch.

From a point of view of cost, the bit 16 may comprise a regular polygonal rod with merely one end machined to provide the screw engaging tip 20. Utilizing such a rod avoids the requirement for difficult machining to reduce the size of the polygonal portion to be received within the socket. Utilizing a polygonal rod, however, typically requires a larger diameter socket.

Figure 5:
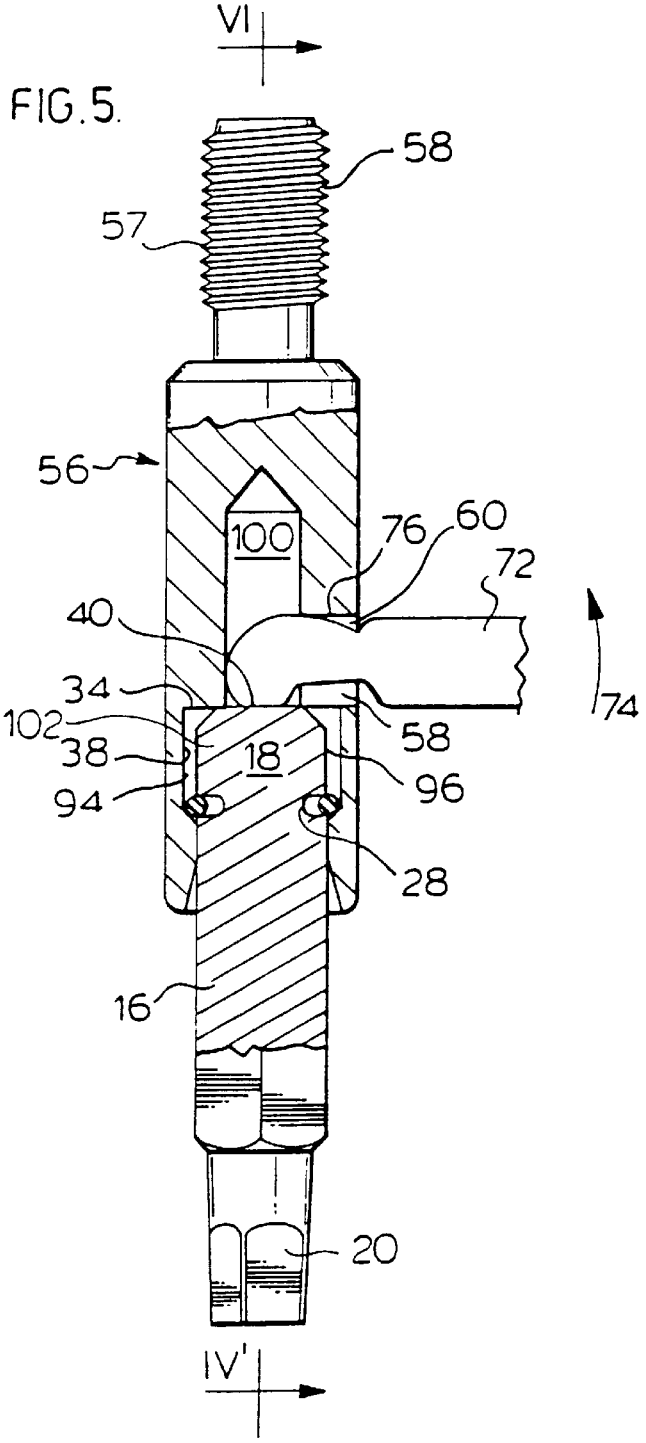
FIG. 5 is a partially cross-sectional side view of a second embodiment of the invention showing a mandrel extension, a replaceable bit and a lever tool to assist in removal of the bit.
Figure 6:
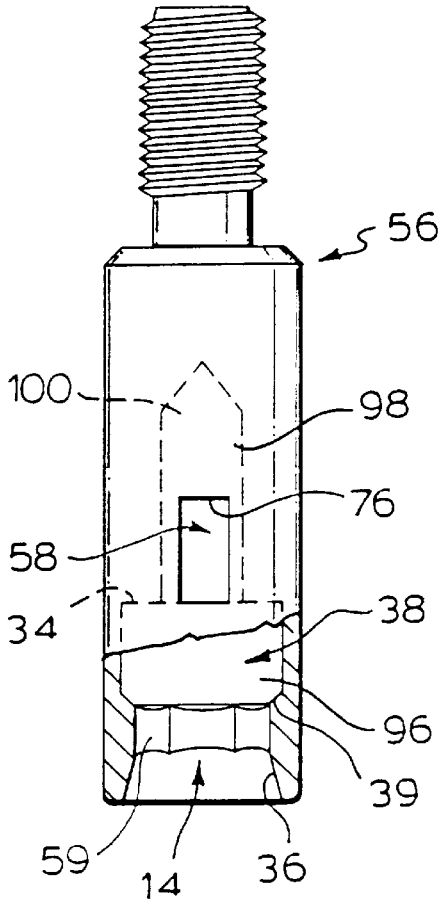
FIG. 6 is a partially cross-sectional side view of the mandrel extension of FIG. 6 along section lines VI—VI' in FIG. 5 with the lever tool removed.

Reference is now made to FIGS. 5 and 6 which show a mandrel extension 56 and a bit 16 in accordance with a second embodiment having all of the features of the first embodiment of FIGS. 1 and 2 but including additional features.

Firstly, mandrel extension 56 has a threaded inner end 57 adapted to be received within a threaded-socket of a mandrel (not shown) of the same exterior diameter.

Secondly, the groove 38 has been extended axially rearwardly from its forward edge 39 to the end wall 34 forming an enlarged socket portion. The groove 38 has cylindrical walls 94 throughout its axial length, which are radially spaced from the hexagonal body 18 of the bit 16 by a space 96 as seen in FIG. 5. The hexagonal portion 59 of the socket 14 of FIGS. 5 and 6 is of a hexagonal shape in cross-section and is spaced forward of the enlarged diameter portion between the forwardmost mouth portion with frustoconcial side walls 36 and the axially enlarged groove 38.

Extending the groove 38 axially rearwardly to the end wall 34 serves the purpose of preventing side surfaces of a rearward portion 102 of the bit 16, which is axially rearward of the groove 28, from engaging the socket 14. It has been found that in use of the embodiment of FIGS. 1 and 2, side loading on the bit 16 resulting from lateral forces between the bit and socket axially rearward of the groove 28, may result in the bit 16 severing off at the groove 28. Preventing the transfer of substantial laterally directed forces between the bit and the socket across groove 28 is believed to overcome this problem. In the embodiment illustrated, such lateral forces are avoided axially rearward of the groove 28 by maintaining a space 96 between the walls of the groove 38 and the rearward portion 102 of the bit 16. Other embodiments to overcome this problem could include, for example, in the context of a socket as in FIGS. 1 and 2, reducing the diameter of the bit axially rearward of its groove 28.

In a similar manner to that of the first embodiment shown in FIGS. 1 and 2, the forward edge 39 of groove 38 acts as a radially inwardly directed retention shoulder to be engaged by the split-ring 30 when the split-ring 30 is axially rearward of edge 39 and thus resist removal of bit 16 from the socket 14.

Thirdly, the mandrel extension 56 is provided with a slot 58 which extends radially inwardly into the mandrel extension from an opening 60 on one side of the mandrel extension 56. The slot 58 is immediately rearward of the socket 14 and open to the socket 14 as best seen in FIG. 5.

An axially centered reduced diameter bore 100 is provided, extending axially rearwardly from the end wall 34 and intersecting the slot 58, with the slot 58 extending radially inwardly from the outer side of the mandrel extension 56 into the bore 100 as shown. Bore 100 has a diameter which is less than that of the end 40 of the bit, such that the bit end 40 continues to engage the end wall 34 to limit rearward movement of the bit 16 into the socket 14.

An elongate lever tool 72 is provided with one end adapted to be inserted into the slot 58 as shown in FIG. 5. By manual levering the remote end of the tool 72 in the direction indicated by arrow 74, the tool engages and applies axially directed forces to the surface of the end 40 of the bit with the axially innermost surfaces of a wall 76 of the slot 58 to be engaged by the tool and acting as a fulcrum. With such a lever tool 72, large axially directed forces can easily, manually be applied to the bit 16 for its removal.

The use of the slot 58 and lever tool 72 is particularly advantageous with mandrels having small diameters, preferably less than ½ inch, as it permits use of resilient retaining devices such as the split-ring 30 to include those which only permit removal of the bit under very strong axial forces.

FIGS. 7 to 11 show a third embodiment of the present invention similar to the second embodiment of FIGS. 5 and 6, however, wherein the bit 16 and socket 14 are provided with relative sizes and shapes so as to permit the bit 16 to assume orientations in which a longitudinal central axis of the bit is inclined relative to a longitudinal central axis through the socket. It has been found that permitting the bit to assume such inclined orientations relative the socket can be advantageous to permit the bit to better engage a screw to be driven.

Figure 7:
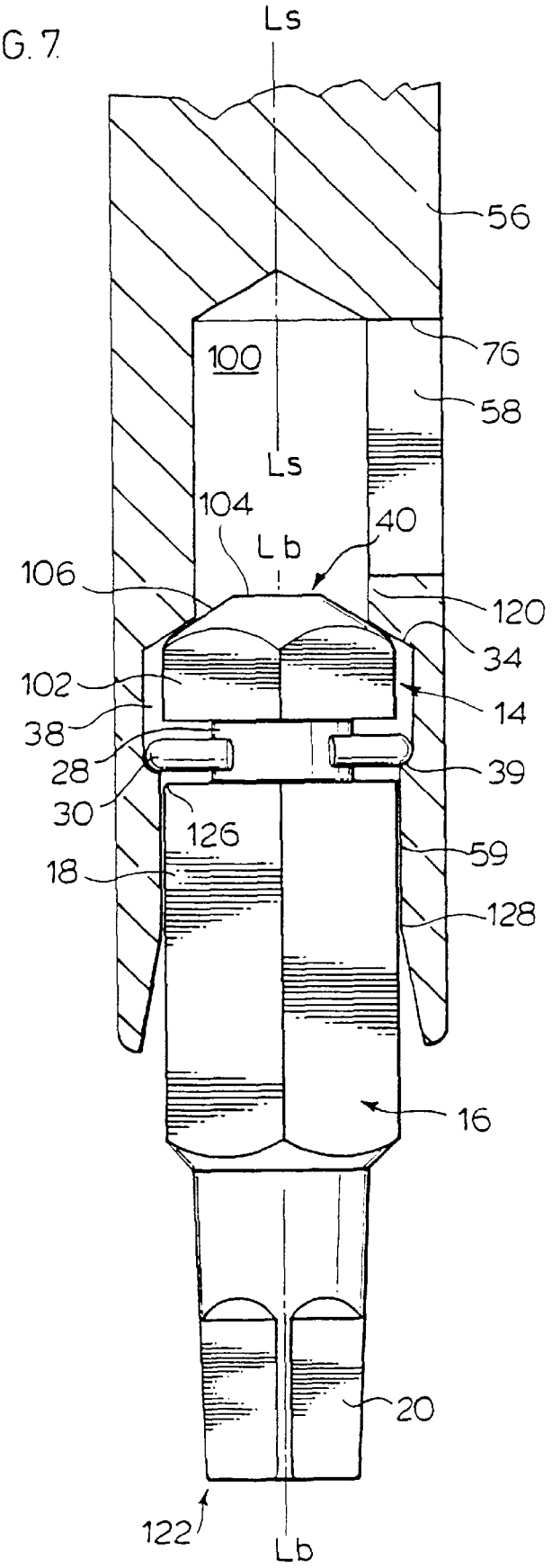
FIG. 7 shows a partial cross-sectional side view of a third embodiment of the invention showing a mandrel extension with the bit fully inserted in a seated position within the socket and aligned with a mandrel axis.
Figure 8:
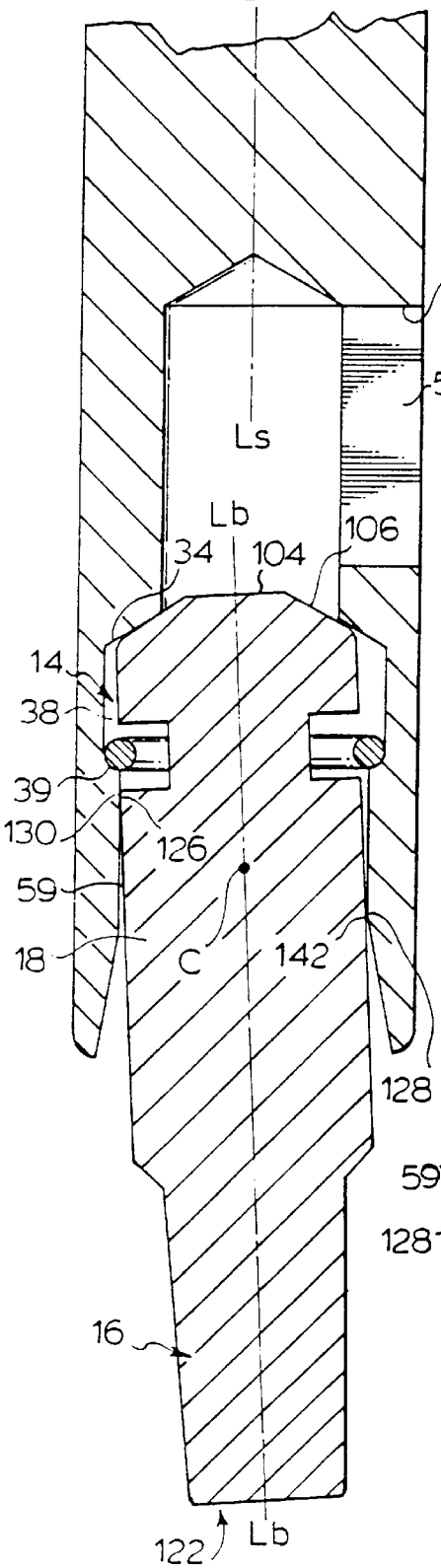
FIG. 8 shows a cross-sectional side view of the mandrel extension of FIG. 7 with the bit in a position within the socket and moved out of alignment with the mandrel axis.

To assist in discussion of FIGS. 7 and 8, the bit 16 is illustrated as having a bit axis shown as $L_b$ which extends longitudinally through the axial center of the bit. Similarly, the socket 14 is illustrated as having a socket axis $L_s$ which extends longitudinally through the axial center of the socket.

The bit 16 of FIGS. 7 and 8 is identical to that of FIGS. 5 and 6 with the exception that the rearward bit end 40 is more clearly delineated into a central flattened portion 104 and a frustoconical portion 106 thereabout tapering inwardly relative the bit axis $L_b$ to the rear as shown.

The socket 14 is identical to that of FIGS. 5 and 6 with two exceptions. A first exception is that the end wall 34 is disposed so as to be frustoconical about the socket axis $L_s$. and tapering radially inwardly to the rear as shown. A second exception is that the slot 58 is spaced rearwardly from the end wall 34 as will be discussed later in greater detail.

Figure 9:
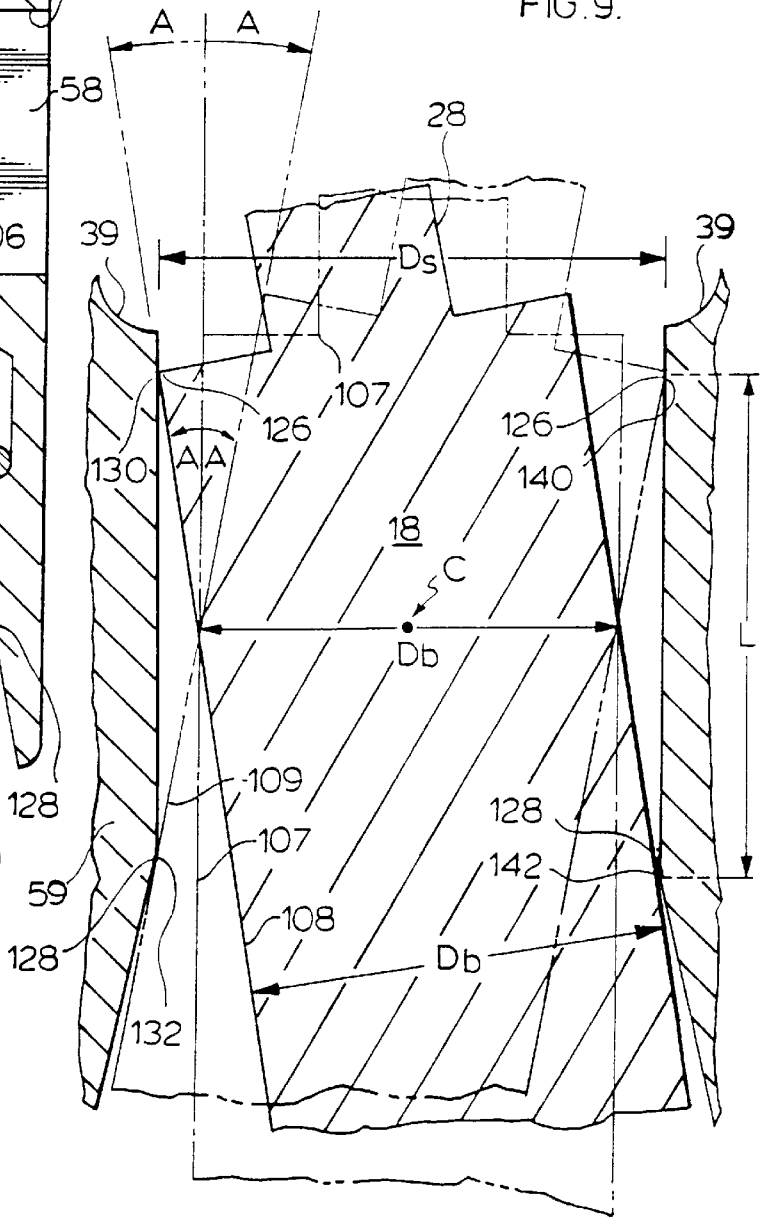
FIG. 9 shows an enlarged partial cross-sectional side view of the polygonal portions of the socket and bit of FIG. 8 showing the movement of the bit relative to the mandrel axis.

An important aspect of the third embodiment as shown in FIGS. 7 to 9 is the desired relative positions the bit can assume within the socket. To permit relative inclination of the bit in the socket, the relative outer diameter of the bit 16 defined as $D_b$ is smaller than the relative inner diameter of the socket defined as $D_s$.

FIGS. 7 and 8 show two different configurations in which the bit is received in the socket and, due to the bit being urged by a force indicated by the arrows 122 rearwardly into the socket, the frustoconical portion 106 of the bit end 40 is urged into engagement with frustoconical end wall 34 of the socket 14.

FIG. 7 shows a first configuration in which the bit $L_b$ and socket axis $L_s$ are coaxial. In contrast, FIG. 8 shows a second configuration in which the bit axis $L_b$ is inclined relative to the socket axis $L_s$ at a maximum possible slope. The maximum amount the bit may incline relative to the socket is dictated by the engagement between the bit and the socket at points indicated as 130 and 142 in FIG. 8.

FIG. 9 best illustrates the relative orientations of the bit and socket in FIGS. 7 and 8. FIG. 9 shows enlarged views of portions of FIGS. 7 and 8 where the hexagonal portions 18 and 59 of the bit 16 and socket 14 engage each other. FIG. 9 shows as the dotted lines indicated 107 the bit 16 as it is positioned in FIG. 7. FIG. 9 shows as solid lines indicated 108 the bit 16 as it is positioned in FIG. 8 inclined with its rear end moved a maximum to the left. FIG. 9 shows as dotted lines indicated as 109 the bit as it would be positioned similar to that in FIG. 8 but inclined with its rear end moved a maximum to the right.

Referring first to the dotted lines 107 showing the bit in the first orientation of FIG. 7 with the bit axis $L_b$ coaxial with the socket axis $L_s$, the sides of the hexagonal portion 18 in this cross-section are spaced from and centered within the hexagonal socket portion 59 of the socket 14.

From the orientation of FIG. 7, the bit can move to be inclined either to the second orientation to the left as shown by solid lines 108 or to the mirror-image second orientation to the right as shown by dotted lines 109. On the bit becoming inclined to the left as shown by solid lines 108 in FIG. 9, the bit is stopped from becoming further inclined to the left by reason of the rear edge 126 of the bit on the left side of the bit contacting the side wall of the socket portion 59 at point 130 on the left of the socket simultaneously with the front edge 128 of the socket portion 59 on the right side of the socket contacting the bit at point 142 on the right side of the bit. Similarly, on the bit becoming inclined to the right as shown by dotted line 109 in FIG. 9, the bit is stopped from becoming further inclined to the right by reason of the rear edge 126 of the bit on the right side of the bit contacting the side wall of socket portion 59 at point 140 on the right of the socket simultaneously with the front edge 128 of the socket portion 59 of the socket contacting the bit at point 132 on the right side of the bit. In FIG. 9, angle A represents the maximum angle that the bit $L_b$ axis can incline relative the socket axis $L_s$. Trigonometrically, this angle can be approximated having regard to the difference between the bit outer diameter, $D_b$, and the socket inner diameter, $D_s$, and the length L between front edge 128 and point 130 by the following relationship:

$$\text{Tangent of angle } A=(D_s-D_b)/L$$

From this relationship, it is apparent that the maximum angle of inclination of the bit relative the socket may be varied by varying one or more of $D_s$, $D_b$ or L. Thus, the difference in size of the diameter of the bit and socket and the relative distance between front edge 128 and point 130 will determine the maximum angle that the bit axis may be inclined relative the socket axis.

In FIG. 9, a first imaginary diagonal line (not shown) between point 130 and point 142 and a second imaginary diagonal line (not shown) between points 140 and point 122 intersect at a point indicated as C in both FIG. 9 and FIG. 8. Point C roughly indicates a point about which the bit 16 may conceptually pivot within the socket in the manner of a ball-and-socket type joint but with the approximate constraint that the maximum inclination in any direction is limited by engagement of hexagonal portion 18 in sockethexagonal portion 59 and therefore as a maximum to angle A.

The ability of the bit 16 to assume different angular inclinations relative the socket 14 as in the manner of a ball-and-socket joint is advantageous for the bit 16 to better engage the recess in the head of a screw, particularly Philips & Robertson type recesses, under situations where the screw is not coaxial with the socket axis. Such a situation frequently arises, for example, with the screw being driven into a work-piece at an angle to the socket or where the screw is disposed to a small extent laterally to one side of the socket axis. Having the bit 16 capable of inclining has surprisingly been found advantageous to avoid not only "cam out" where the bit loses its engagement with a screw but also to reduce jamming where in driving a screw the bit becomes so frictionally engaged in the screw recess that it cannot, except with excessive force, be withdrawn.

Providing the bit 16 to be capable of an inclination angle A of at least 2° and, preferably, between about 2° and 10° has been found preferred. While angle A may be 2°, 3°, 4°, 5°, 6°, 7°, 8°, 9° or 10°, it is more preferably at least 3° and not greater than 6°.

It is preferred that the conceptual point C about which the bit pivots to incline be located as close as possible to the bit end 20. Preferably, the point C is located within a distance of four times the bit diameter $D_b$ of the forward end of head 20 and, more preferably, within 3 or 2 times the bit diameter.

As to other relative possible movements of the bit 16 within the socket 14, it is to be appreciated that since the diameter of the bit is smaller than the diameter of the socket, in addition to the bit assuming inclined orientations relative the socket, the bit may move side to side, that is, for example, to assume different lateral positions in which its bit axis is parallel to the socket axis.

As was the case with the second embodiment of FIGS. 5 and 6 in accordance with the third embodiment of FIGS. 7 to 11, the bit and socket are complementarily sized and shaped such that laterally directed forces acting on the bit rearward of groove 28 are attempted to be minimized. For example, even when the bit is inclined to a maximum as illustrated in FIG. 8, the bit and socket are configured by having the major laterally acting forces act on points 130 and 142 forward of groove 28 and minimal laterally acting forces acting rearward of groove 28. By laterally directed forces, it is meant forces normal to the socket axis. In this regard, enlarged groove 38 is sufficiently large that the side walls of rear portion 102 do not engage the socket in any permitted orientation of the bit in the socket. As contrasted with end portion 102, the socket end wall 34 is engaged by frustoconical portion 106 of the bit. However, the engagement between and the relative disposition of frustoconical end wall 34 and frustoconical portion 106 is such that the frustoconical portion 106 is adapted to slide laterally on the end wall 34 relative the socket axis. Thus, to the extent any substantial laterally directed forces attempt to transfer between the end wall 34 and the frustoconical portion 106, they interact as to provide camming surfaces to permit the end of the bit to slide laterally relative the socket axis. The end wall 34 and the frustoconical portion 106 also engage to act as stop surfaces to transfer substantial forces directed generally parallel to the socket axis as are necessary to drive screws.

In the second and third embodiments, configuring the bit and socket so as to reduce laterally directed forces which act on the bit rearward of the groove 28, assists in minimizing laterally directed forces acting on both ends of the bit across the groove which may cause the bit to snap at the groove which is the bit's laterally weakest point. This is particularly important with smaller size bits of a diameter less than ¼ inch particularly as shown where the bit has a substantial groove as necessary for the split-ring to be carried on the bit.

For ease of illustration, FIG. 8 and outline 108 in FIG. 9 each show a cross-sectional view in which the straight rear edge 126 on the lefthand side of the bit is disposed to lie in the plane of the planar lefthand side surface of hexagonal portion 59 of the socket. The cross-section of FIG. 8 is through the bit axis normal the opposed side surfaces of the bit. In this regard, the bit diameter $D_b$ is shown as the distance between opposite, parallel sides of the bit and, similarly, the socket diameter $D_s$ is shown as the distance between opposite, parallel surfaces of the socket. The bit will not always adopt configurations in which the engaging rear edge 126 lies in the plane of one of the side surfaces of the hexagonal portions 59. For example, in a configuration shown in FIG. 7 with the bit axis and socket axis coaxial, for transfer of clockwise rotational forces from the socket to the bit, the socket will rotate clockwise a certain extent before the side surface of the polygonal portion of the socket engages the apexes of the bit between hexagonal surfaces of the bit. In FIG. 8, the extent to which the socket will be rotated before it engages the bit apexes will be determined by the difference in bit diameter $D_b$ and socket diameter $D_s$. It is preferred that the socket need not be rotated excessively before it engages the bit and, accordingly, to obtain a maximum inclination angle A, it is more preferred that the length L be shorter than the difference in diameters be excessive. Of course, the maximum difference in diameter is limited in that the polygonal bit must be rotated by the socket.

The groove 28 and enlarged groove 38 are sized and shaped so that when the bit is urged rearwardly into the socket as seen in FIGS. 7 and 8, the split-ring is carried freely on the bit and does not become caught between the bit and socket so as to transfer forces therebetween. In FIGS. 7 and 8, the split-ring sits on the lower shoulder of groove 38 as located by gravity.

In FIGS. 7 and 8, the frustoconical bit surface 104 and frustoconical end wall 34 are complementary to each other. Preferably, they extend at an angle of approximately 40° to 80° and, more preferably, at an angle of 45° to 60° inclined relative to the respective bit and mandrel axis. With the end wall 34 and portion 106 both frustoconical, on forces urging the bit axially into the socket, by reason of the interaction of the surfaces, in the absence of other more substantial laterally directed forces, the rear end of the bit tends to coaxially center itself within the end wall 34 of the socket.

As in the second embodiment of FIGS. 5 and 6, the mandrel extension 56 of the third embodiment of FIGS. 7 to 11 includes a slot 58 opening axially into the bore 100. In contrast with FIGS. 5 and 6, in FIG. 7, slot 58 is spaced axially rearward from the end wall 34, separated therefrom by a reinforcing wall portion 120. Reinforcing wall portion 120 separates the end wall 34 of the socket 16 from the slot 58 to advantageously eliminate a potential weak spot in the socket at the juncture of the enlarged groove 38 and the slot 58. The reinforcing wall portion 120 forms part of a continuous circumferential ring about the socket rearward of the enlarged groove 38. As was the case with the second embodiment of FIGS. 5 and 6, the third embodiment of FIGS. 7 to 11 provides an elongate lever tool 72 for removal of the bit 16 via slot 58. The lever tool 72 shown in FIGS. 10 and 11 has been modified to account for reinforced wall portion 120 and is provided with a hooked first end 110, adapted for insertion into the socket 14 via the slot 58 and for movement therein forward of the reinforcing wall portion 120.

Figure 10:
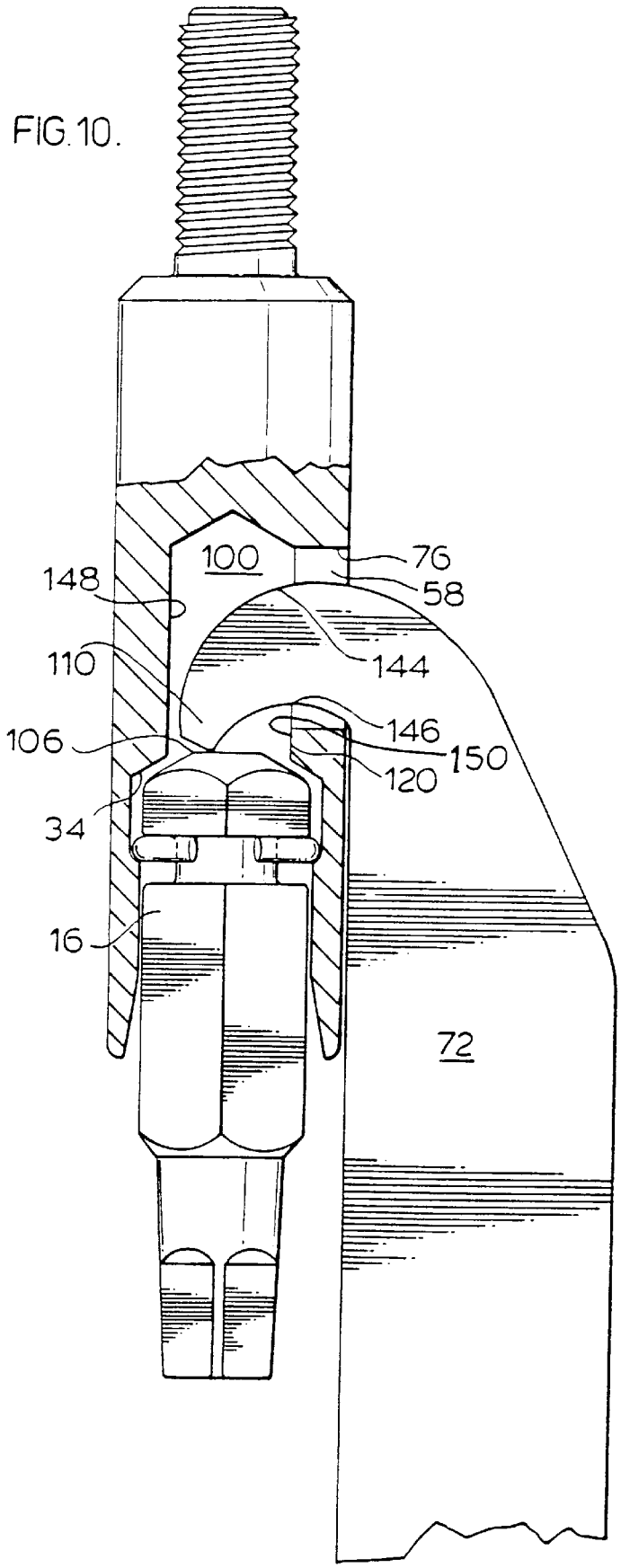
FIGS. 10 and 11 show the mandrel extension of FIG. 7 together with the lever tool to assist in removal of the bit.
Figure 11:
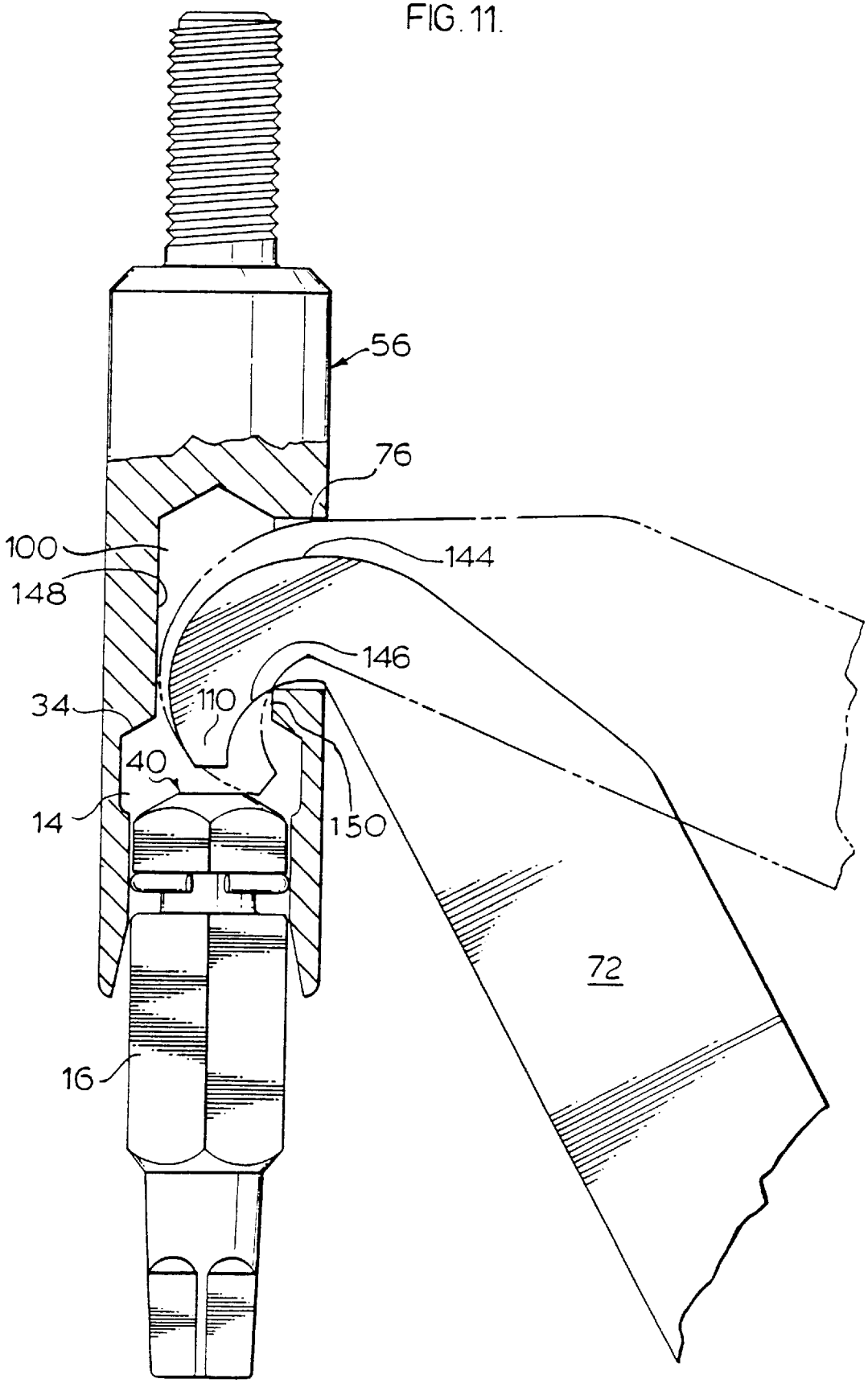

FIGS. 10 and 11 show the first end 110 of the lever tool 72 inserted in the slot 58. Pivotal movement of the lever tool 72 about the slot 58 from the position shown in FIG. 10 to the position shown in FIG. 11 moves the first end 110 of the tool 72 to engage the flat portion of the bit end 40, with the inner surfaces of a wall 76 of the slot 58 to be engaged by the tool 72 and acting as a fulcrum, to apply the required axial force necessary to remove the bit 16. The hook of tool 72 has both curved outer surface 144 and inner surface 146 to assist in camming action via surfaces 76, 148 and 150 in pivoting of the tool.

As is to be appreciated from a review of FIGS. 5, 10 and 11, the hook of tool 72 is removably insertable via the slot 58 into the socket 14 to assume positions with the distal end of the hook extending forwardly relative the slot into the socket to engage the rear end 40 of the bit with a rearwardly directed portion of the outer surface 144 remote from the distal end of the hook engaging the forwardly directed surface 76 of the slot simultaneously with a radially directed portion of the surfaces 144 and 146 closer to the distal end than the rearwardly directed portion engaging the side wall of the socket such that on pivotal levered movement of the remote end of the tool in one direction relative the slot, the engagement of the surfaces of the hook with the surface 76 and side wall of the socket with increased pivotal movement of the tool guides and cams the distal end of the hook increasingly forwardly into the socket sufficient that the distal end moves the bit forwardly to engage the rear end of the bit and move the bit forwardly relative the socket. As seen in FIGS. 10 and 11 in which the reinforcing wall portion is disposed between the forward end of the slot and the rear end of the bit, the distal end of the hook is received on initial insertion within the continuous circumferential ring formed by the reinforcing wall portion 120. On pivoting of the lever tool with a rearwardly directed portion of outer surface 144 engaging the surface 76, the hook may be maintained in the socket and cammed therein either by another portion of outer surface 144 closer to the distal end engaging the side wall 148 on the side of the socket opposite from the slot or by a portion of inner surface 146 engaging the side wall 150 of the socket formed by the reinforcing wall portion 120 on the same side of the socket as the slot.

Figure 12:
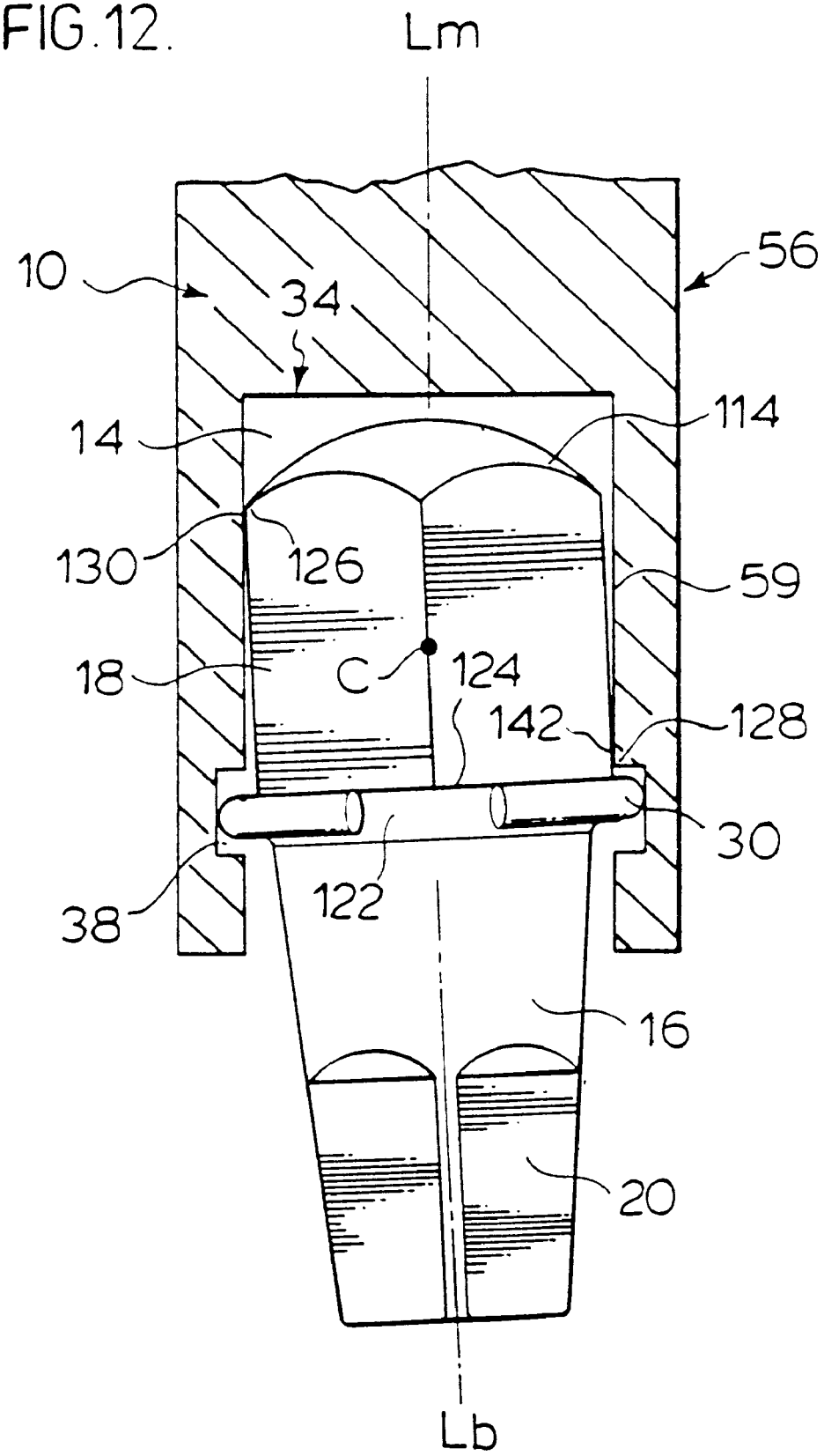
FIG. 12 shows a partial cross-sectional side view of a fourth embodiment of the invention showing a mandrel extension with a bit retained in a socket and moved out of axial alignment with the mandrel axis.

FIG. 12 shows a third embodiment of the present invention which is a simplified embodiment adapted preferably to permit the bit to adopt inclination relative the socket in a manner similar to that described with FIGS. 7 to 11.

In FIG. 12, the hexagonal portion 18 of the bit and the hexagonal portion 59 of the socket are rearward of grooves 38 holding split-ring 30 such that the split-ring 30 is to be carried in socket 14. The bit has a groove-like reduced diameter portion 122 presenting a forwardly directed shoulder 124 to engage on split-ring 30 and hold the bit in the socket. The reduced diameter portion 122 of the bit must be strong enough to transfer rotational forces from portion 18 to bit end 20.

The rear surface 34 of the socket is shown as flat to be engaged by rear surface 40 of the bit which is rounded to assist in the rear surface 40 sliding laterally on rear surface 34. As with the third embodiment, preferably, the bit axis may be inclined at least 2° and, more preferably, at least 3° to 10° relative to the socket axis.

In the manner of the embodiment shown in FIGS. 7 to 11, the bit 16 is sized relative the socket 14 to be movable from a first orientation with the bit axis and socket axis coaxial to second orientations as shown in FIG. 12 wherein the longitudinal bit axis $L_b$ is inclined relative to the longitudinal mandrel axis $L_m$ a maximum amount limited by reason of the bit engaging the socket at points 130 and 142. The bit 14 is substantially free to pivot roughly about a point indicated as C in a ball-and-socket manner.

Figure 14:
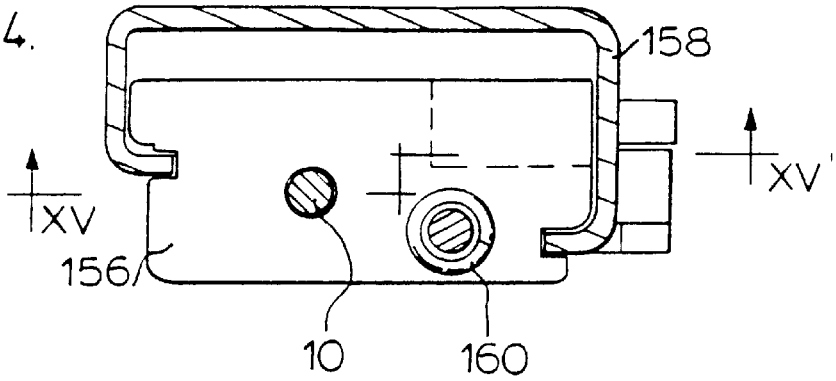
FIG. 14 is a cross-sectional top view of the power driver of FIG. 13 along section line XIV—XIV'.
Figure 13:
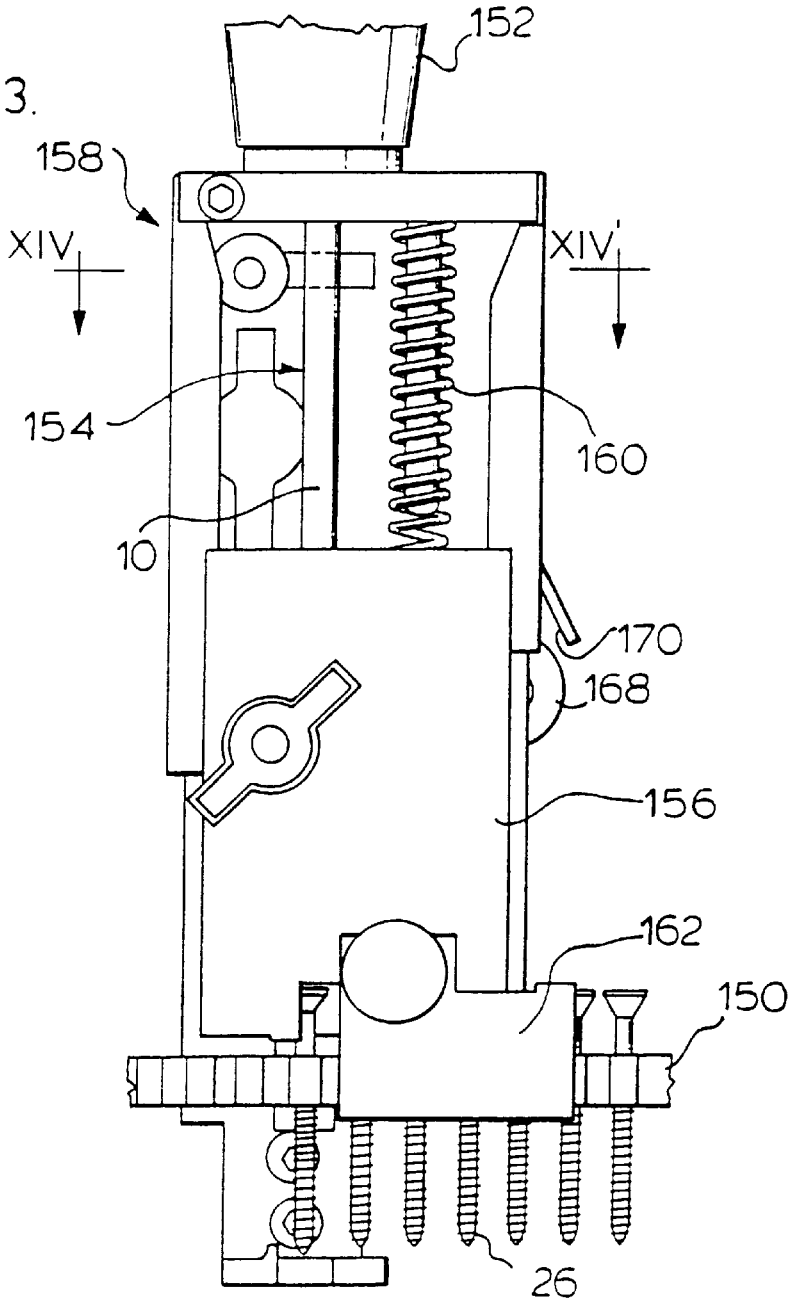
FIG. 13 is a pictorial front view of the power driver of U.S. Pat. No. 4,146,071 including modifications in accordance with the present invention and with the slide body in an extended position.
Figure 15:
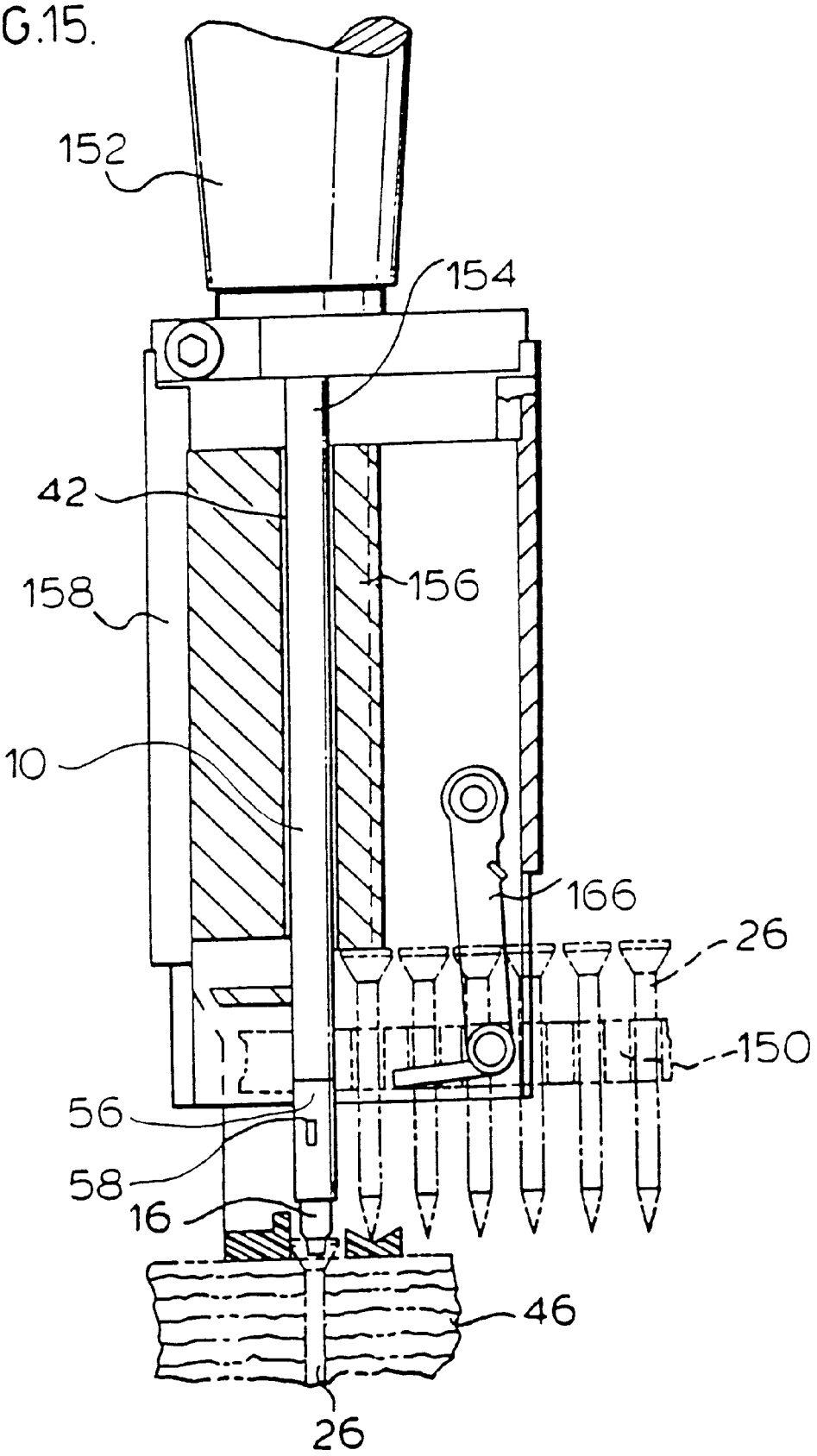
FIG. 15 is a schematic, cross-sectional side view of the power driver of FIG. 14 along section line XV—XV'.

Reference is made to FIGS. 13, 14 and 15 which show, in part, an electrically powered screwdriver of the type disclosed in U.S. Pat. No. 4,146,071 and utilizing a mandrel extension 56 and bit 16, in accordance with the third embodiment of FIGS. 7 to 11. The screwdriver is used in driving screws 26 which have been collated and secured together in a parallel spaced relationship by a retaining strip 150, preferably of plastic. Such strips 150 are taught in U.S. Pat. No. 4,167,229.

The screwdriver includes a chuck 152 which is rotated by an electric motor of a power driver not otherwise shown. The chuck 152 engages an end of an elongate metal drive shaft 154 best seen in FIG. 15 consisting of the generally cylindrical metal mandrel 10 having threadably removably secured to a lowermost end thereof the mandrel extension 56 carrying metal bit 16. As in FIGS. 1 and 2, bit 16 defines at a forwardmost end a screwdriving tip 20, adapted for engaging a complementary shaped recess 22 formed in the head 24 of the screw 26. In a manner described in greater detail hereafter, while rotating, the mandrel 10 carrying the bit 16 is reciprocated within a guideway 42 in slide body 156 to engage and drive successive screws 26 into a work-piece 46. The screwdriver has identical elements and operates to drive screws in an identical manner to that disclosed in U.S. Pat. No. 4,146,071.

In this regard, as best seen in FIGS. 13, 14 and 15, the screwdriver has a housing 158 to which a power driver (not shown) is fixed by the power driver's chuck 152. Slide body 156 is coupled to housing 158 for sliding displacement parallel to a longitudinal axis through the shaft 154 between an extended position as shown in FIG. 13 and a retracted position shown in FIG. 15. Coil spring 160 biases the slide body 156 relative to the housing 158 to the extended position. The slide body 156 includes a guide channel to guide the screw strip 150 carrying the screw 26. The guide channel is defined under a removable cover plate 162 shown in FIG. 13. A screw feed advance mechanism is mounted in slide body 156 and activated by relative movement between the housing 158 and the slide body 156. In this regard, pawl arm 166, shown in FIG. 15, reciprocates back and forth to advance successive screws. Pawl arm 166 is moved by a mechanical linkage including levers (not shown) moved by wheel 168 engaging ramped surface 170 of the housing 158 shown in FIG. 13 in the slide body 156 reciprocating between extended and retracted positions.

In a known manner, as seen in FIG. 15, the guideway tube 42 has a lower righthand portion removed so as to provide a screw access opening sized to permit a screw 26 carried on the strip 15 advancing in the screw guide channel to move radially inwardly into the guideway 42 from the right as seen in the FIGS. The screw preferably has a screw head diameter only marginally smaller than the diameter of the guideway 42 so that the interior wall 44 of the guideway 42 engages the radially outermost periphery of the head 24 of a screw 26 to locate the screw 26 coaxially within the guideway 42 in axial alignment with the mandrel 10 for engagement by the bit in driving a screw from the guideway.

The guideway 42 serves to axially guide and locate each of the mandrel 10 and a screw 26 to be driven by engagement of surfaces of the mandrel and by engagement of the head of the screw.

FIG. 15 shows the slot 58 on mandrel extension 56 is readily accessible when the slide body 156 is in the retracted position. It is to be appreciated that with the slide body 156 held in an extended position and the chuck 152 of the power driver not rotating, the elongate lever tool 72 may readily be located axially in line with the mandrel 10, engaged within slot 58 and pivoted to receive a bit 16. Thus, a bit 16 may readily be removed and a new bit inserted without any disassembly of the power driver.

The present invention has been described with reference to use in a power screwdriver for driving collated strips of screws. The invention is not so limited and may be applied to any tool or device. Such tools include, but are not limited to, socket wrenches, hand screwdrivers, nut drivers and the like.

The socket 14 has been preferably disclosed as hexagonally shaped in cross-section. It is to be appreciated that other socket shapes may be useful including other polygonal shapes or other shapes which may be part polygonal only. Of course, a complementary bit would be used such that the bit will rotate with the socket.

The invention has been described with, as a preferred vehicle to secure the bit into the socket, a resilient metal split-ring. Other types of resilient coupling systems may be used. For example, an elastic O-ring of plastic or nylon may be stretched so as to initially be received in the groove 28 in the bit 16 and be radially inwardly deformable about its circumference so as to permit insertion of the bit into a socket.

Replacement of the resilient coupling system with each bit permits use of coupling vehicles which only need to be able to be introduced into the socket and removed therefrom once. As such, a resilient coupling such as one of relatively rigid plastic which may be broken on withdrawal as under the substantial forces required to move the bit could be useful. Other resilient couplings could be used preferably carried by the bit for removal and replacement with each replacement of the bit.

Although the invention has been described with reference to preferred embodiments, it is not so limited. Many variations and modifications will now occur to persons skilled in the art. For a definition of the invention, reference is made to the appended claims.

We claim:

1. A screwdriver comprising a mandrel elongated along and rotatable about a longitudinal mandrel axis, the mandrel having at a forward end a socket extending from socket opening at the forward end of the mandrel rearwardly along the mandrel axis to rearward end characterized by:

the socket having a forward section polygonally shaped in cross-section, an enlarged diameter portion spaced rearwardly from the forward section, and a forwardly and axially directed socket stop surface spaced rearwardly from the enlarged diameter portion, a replaceable bit extending along a bit axis from a forward bit end to a rearward bit end, generally coaxially removably received in the socket, the bit having a polygonal body portion polygonally shaped in cross-section complementary to the polygonally shaped forward section of the socket for transfer of rotational forces from the socket to the bit, a rearward bit portion rearward of the polygonal body portion, a rearwardly and axially directed bit stop surface spaced rearwardly from the rearward bit portion, and an inwardly extending annular groove about the bit defining a reduced diameter portion intermediate the polygonal body portion and the rearward bit portion, wherein with the bit urged fully rearwardly into the socket:

(a) the rearward bit portion locates within the enlarged ditmeter portion for lateral movement therein;

(b) the bit stop surface engages the socket stop surface to transfer between the bit and the mandrel substantially all compressive forces acting generally parallel to the mandrel axis between the bit and the mandrel yet permitting lateral sliding movement of the bit stop surface on the socket stop surface relative to the mandrel axis in response to compressive forces acting generally normal to the mandrel axis between the bit and mandrel;

(c) the polygonal body portion locates within the forward section for lateral movement therein with engagement between surfaces of the polygonal body portion and the forward section of the socket preventing inclination of the bit axis relative the mandrel axis beyond a maximum angle of inclination in any direction;

(d) the forward end of the bit extends from the socket opening for driving a screw into a work piece;

(e) other than engagement between the socket stop surface and the bit stop surface, the rearward bit portion is spaced laterally out of contact with the socket rearward of the reduced diameter portion of the bit; and (f) the bit stop surface is laterally slidable on the socket stop surface from any position thereon, in response to compressive forces acting generally normal to the mandrel axis between the bit and the mandrel, to positions in which the bit axis assumes the maximum angle of orientation in any direction and contact between the polygonal body portion and the forward section of the socket transfers therebetween substantially all compressive forces between the bit and the mandrel acting generally normal to the mandrel axis.

2. A screwdriver as claimed in claim 1 wherein the socket stop surface is disposed at an angle relative the mandrel axis with the socket stop surface extending radially inwardly towards the mandrel axis and rearwardly towards the rearward end of the socket.

3. A screwdriver as claimed in claim 2 further characterized by the body portion of the bit and the forward section of the socket engaging each other for transfer of rotational forces there between such that rotational forces do not pass axially through the reduced diameter portion of the bit.

4. A screwdriver as claimed in claim 1 wherein the socket stop surface is frustoconical about the mandrel axis with the socket stop surface extending radially inwardly towards the mandrel axis from the enlarged diameter portion and rearwardly towards the rearward end of the socket.

5. A screwdriver as claimed in claim 4 wherein the bit stop surface is frustoconical about the bit axis with the bit stop surface extending radially inwardly towards the bit axis and rearwardly towards the rearward bit end, the bit stop surface being complementary to the socket stop surface to facilitate relative lateral sliding movement of the bit stop surface relative the socket stop surface.

6. A screwdriver as claimed in claim 1 including a locking member carried by one of the mandrel and the bit located partially in the groove and partially in the enlarged diameter portion to retain the bit in the socket against removal.

7. A screwdriver as claimed in claim 6 wherein the locking member is resiliently deformable and is located partially in the groove and partially in the enlarged diameter portion to retain the bit in the socket against removal under axially directed forces less than a required force.

8. A screwdriver as claimed in claim 7 further characterized by the locking member comprising a split-ring being carried by and removable with the bit.

9. A screwdriver as claimed in claim 1 further characterized by the bit and socket sized to permit movement of the bit in the socket between a first orientation where the bit axis is aligned with the mandrel axis, and a plurality of second orientations where the bit axis is inclined at an angle of at least 2° and not more than 10° relative to the mandrel axis and further inclination of the bit axis relative to the mandrel axis is prevented by engagement between surfaces of the polygonal body portion and the forward section of the socket.

10. A screwdriver as claimed in claim 1 further characterized by the body portion of the bit and the forward section of the socket engaging each other for transfer of rotational forces therebetween such that rotational forces do not pass axially through the reduced diameter portion of the bit.

11. A screwdriver as claimed in claim 1 further characterized by the socket including an axially extending reduced diameter bore extending rearwardly from the socket stop surface of the socket, a slot extending radially inwardly from an opening in one side of the mandrel into the reduced diameter bore, the slot sized to permit insertion of a tool there through for applying an axially directed force on the bit to remove the bit.

12. A screwdriver as claimed in claim 11 further characterized by the slot means being located rearwardly spaced from the socket stop surface and opens axially into the socket.

13. A screwdriver comprising a mandrel elongated along and rotatable about a longitudinal mandrel axis, the mandrel having at a forward end a socket extending from a socket opening at the forward end of the mandrel rearwardly along the mandrel axis to a rearward end characterized by:

the socket having a forward section polygonally shaped in cross-section, an enlarged diameter portion spaced rearwardly from the forward section, and a forwardly and axially directed socket stop surface spaced rearwardly from the enlarged diameter portion, a replaceable bit extending along a bit axis front a forward bit end to a rearward bit end, generally coaxially removably received in the socket, the bit having a polygonal body portion polygonally shaped in cross-section complementary to the polygonally shaped forward section of the socket for transfer of rotational forces from the socket to the bit, a rearward bit portion rearward of the polygonal body portion, a rearwardly and axially directed bit stop surface spaced rearwardly from the rearward bit portion, and an inwardly extending annular groove about the bit defining a reduced diameter portion intermediate the polygonal body portion and the rearward bit portion, wherein with the bit urged fully rearwardly into the socket:

(a) the rearward bit portion locates within the enlarged diameter portion for lateral movement therein;

(b) the bit stop surface engages the socket stop surface to transfer between the bit and the mandrel substantially all compressive forces acting generally parallel to the mandrel axis between the bit and the mandrel yet permitting lateral sliding movement of the bit stop surface on the socket stop surface relative to the mandrel axis;

(c) the polygonal body portion locates within the forward section for lateral movement therein with engagement between surfaces of the polygonal body portion and the forward section of the socket preventing inclination of the bit axis relative the mandrel axis beyond a maximum angle of inclination in any direction and transferring between surfaces of the polygonal body portion and the forward section of the socket substantially all compressive forces between the bit and the mandrel acting generally normal to the mandrel axis, (d) the forward end of the bit extends from the socket opening for driving a screw into a work piece;

(e) other than engagement between the socket stop surface and the bit stop surface, the rearward bit portion is spaced laterally out of contact with the socket rearward of the reduced diameter portion of the bit; and (f) the bit stop surface laterally slidable on the socket stop surface to positions in which the polygonal body portion and the forward section of the socket engage and prevent inclination of the bit axis relative the mandrel axis beyond the maximum angle of inclination in any direction.

14. A screwdriver as claimed in claim 13 wherein the socket stop surface is disposed at an angle relative the mandrel axis with the socket stop surface extending radially inwardly towards the mandrel axis and rearward end of the socket.

15. A screwdriver as claimed in claim 13 wherein the socket stop surface is frustoconical about the mandrel axis with the socket stop surface extending radially inwardly towards the mandrel axis from the enlarged diameter portion and rearwardly towards the rearward end of the socket.

16. A screwdriver as claimed in claim 15 wherein the bit stop surface is frustoconical about the bit axis with the bit stop surface extending radially inwardly towards the bit axis and rearwardly towards the rearward bit end, the bit stop surface being complementary to the socket stop surface to facilitate relative lateral sliding movement of the bit stop surface relative the socket stop surface.

17. A screwdriver comprising a mandrel elongated along and rotatable about a longitudinal mandrel axis, the mandrel having at a forward end a socket extending from a socket opening at the forward end of the mandrel rearwardly along the mandrel axis to a rearward end characterized by:

the socket having a forward section polygonally shaped in cross-section, an enlarged diameter portion spaced rearwardly from the forward section, and a forwardly and axially directed socket stop surface spaced rearwardly from the enlarged diameter portion, a replaceable bit extending along a bit axis from a forward bit end to a rearward bit end, generally coaxially removably received in the socket, the bit having a polygonal body portion polygonally shaped in cross-section complementary to the polygonally shaped forward section of the socket for transfer of rotational forces from the socket to the bit, a rearward bit portion rearward of the polygonal body portion, a rearwardly and axially directed bit stop surface spaced rearwardly from the rearward bit portion, and an inwardly extending annular groove about the bit defining a reduced diameter portion intermediate the polygonal body portion and the rearward bit portion, wherein with the bit urged fully rearwardly into the socket:

(a) the rearward bit portion locates within the enlarged diameter portion for lateral movement therein;

(b) the bit stop surface engages the socket stop surface to transfer between the bit and the mandrel substantially all compressive forces acting generally parallel to the mandrel axis between the bit and the mandrel yet permitting lateral sliding movement of the bit stop surface on the socket stop surface relative to the mandrel axis;

(c) the polygonal body portion locates within the forward section for lateral movement therein with engagement between surfaces of the polygonal body portion and the forward section of the socket preventing inclination of the bit axis relative the mandrel axis beyond a maximum angle of inclination in any direction;

(d) the forward end of the bit extends from the socket opening for driving a screw into a work piece;

(e) other than engagement between the socket stop surface and the bit stop surface, the rearward bit portion is spaced laterally out of contact with the socket rearward of the reduced diameter portion of the bit; and (f) engagement between the bit stop surface and the socket stop surface facilitates lateral sliding movement of the bit stop surface on the socket stop surface such that compressive forces between the bit and the mandrel acting generally normal to the mandrel axis are substantially transferred forward of the reduced diameter portion between the polygonal body portion and the forward portion of the socket, wherein the socket stop surface is disposed at an angle relative the mandrel axis with the socket stop surface extending radially inwardly towards the mandrel axis and rearwardly towards the rearward end of the socket.

18. A screwdriver as claimed in claim 17 wherein the socket stop surface is frustoconical about the mandrel axis with the socket stop surface extending radially inwardly towards the mandrel axis from the enlarged diameter portion and rearwardly towards the rearward end of the socket.

19. A screwdriver as claimed in claim 18 wherein the bit stop surface is frustoconical about the bit axis with the bit stop surface extending radially inwardly towards the bit axis and rearwardly towards the rearward bit end, the bit stop surface being complementary to the socket stop surface to facilitate relative lateral sliding movement of the bit stop surface relative the socket stop surface.

20. A screwdriver as claimed in claim 19 further characterized by the body portion of the bit and the forward section of the socket engaging each other for transfer of rotational forces there between such that rotational forces do not pass axially through the reduced diameter portion of the bit.

* * * * *

UNITED STATES PATENT AND TRADEMARK OFFICE

CERTIFICATE OF CORRECTION

PATENT NO. : 5,918,512
DATED : July 6, 1999
INVENTOR(S) : G. Lyle Habermehl and Paul T. Scherer It is certified that error appears in the above-identified patent and that said Letters Patent is hereby corrected as shown below:

Column 1,
Line 2, reads "Ser. No. 08/255,949" should read -- Ser. No. 08/673,615 filed June 25, 1996 which is a continuation of U.S. patent application Ser. No. 08/255,949 --

Column 10,
Lines 58-59, "Sock-ethexagonal should read -- socket hexagonal --

Column 18,
Line 19, "and reaward end" should read -- and rearwardly towards the rearward end --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*